US005545009A

United States Patent [19]

Ke

[11] Patent Number: 5,545,009

[45] Date of Patent: Aug. 13, 1996

[54] HOT AIR/COLD AIR DUAL-MODE ELECTRIC FAN

[76] Inventor: Chin-Fu Ke, 4F, No. 71-1, Chung Yang Rd. Sec. 3, To Cheng City, Taipei, Taiwan

[21] Appl. No.: 525,130

[22] Filed: Sep. 8, 1995

[51] Int. Cl.[6] ..... F04D 29/58

[52] U.S. Cl. ..... 416/95; 416/39; 416/247 R; 392/362

[58] Field of Search ..... 416/39, 95, 100, 416/247 R, 3; 392/361, 362

[56] References Cited

U.S. PATENT DOCUMENTS

| | | | |
|---|---|---|---|
| 684,459 | 10/1901 | Porter | 392/362 |
| 1,737,912 | 12/1929 | Bogard | 392/362 |
| 1,784,528 | 12/1930 | Lidke et al. | 392/362 |
| 2,110,621 | 3/1938 | Cohen | 392/362 |
| 2,912,159 | 11/1959 | Ganger et al. | 416/95 |
| 5,230,606 | 7/1993 | Chin-Fu | 416/39 |

FOREIGN PATENT DOCUMENTS

| | | | |
|---|---|---|---|
| 0557975 | 12/1943 | United Kingdom | 392/362 |

*Primary Examiner*—Edward K. Look
*Assistant Examiner*—Christopher Verdier
*Attorney, Agent, or Firm*—Bacon & Thomas

[57] ABSTRACT

A hot air/cold air dual-mode electric fan including a vane assembly having an electric heating coil in the mica sheets of each vane, a bakelite mount fixedly secured to the vane assembly and having a circuit board with backward female contacts, a barrel mounted inside a holder in front of a motor and having separated carbon brushes, a shaft mounted within the barrel and coupled to the motor and having male contacts respectively connected to the female contacts and separated copper rings respectively disposed in contact with each carbon brush, and a control circuit for controlling power supply to the electric heating coils and regulating its heating temperature, so that the vane assembly produces currents of cold air when the motor is started and power supply is cut from the electric heating coils by the control circuit, or currents of hot air when the motor is started and power supply is connected to the electric heating coil by the control circuit.

8 Claims, 5 Drawing Sheets

HOT AIR/COLD AIR DUAL-MODE ELECTRIC FAN

BACKGROUND OF THE INVENTION

The present invention relates to electric fans, and relates more particularly to such an electric fan which can be controlled to produce currents of hot air or currents of cold air alternatively.

U. S. Pat. No. 5,230,606, issued to the present inventor, discloses an electric fan with hot air/cold air dual-mode control which can be controlled to produce a current of cold air for cooling the people or a current of hot air for warming a room. This structure of electric fan is functional. However, it is complicated in structure, and therefore its manufacturing cost is high.

SUMMARY OF THE INVENTION

The present invention has been accomplished to provide a hot air/cold air dual-mode electric fan which is simple in structure and inexpensive to manufacture. According to one embodiment of the present invention, the hot air/cold air dual-mode electric fan comprises a vane assembly having an electric heating coil in the mica sheets of each vane, a bakelite mount fixedly secured to the vane assembly and having a circuit board with backward female contacts, a barrel mounted inside a holder in front of a motor and having separated carbon brushes, a shaft mounted within the barrel and coupled to the motor and having male contacts respectively connected to the female contacts and separated copper rings respectively disposed in contact with each carbon brush, and a control circuit for controlling power supply to the electric heating coils and regulating its heating temperature, so that the vane assembly produces currents of cold air when the motor is started and power supply is cut from the electric heating coils by the control circuit, or currents of hot air when the motor is started and power supply is connected to the electric heating coil by the control circuit.

DETAILED DESCRIPTION OF THE PREFERRED EMBODIMENT

Figure 1:
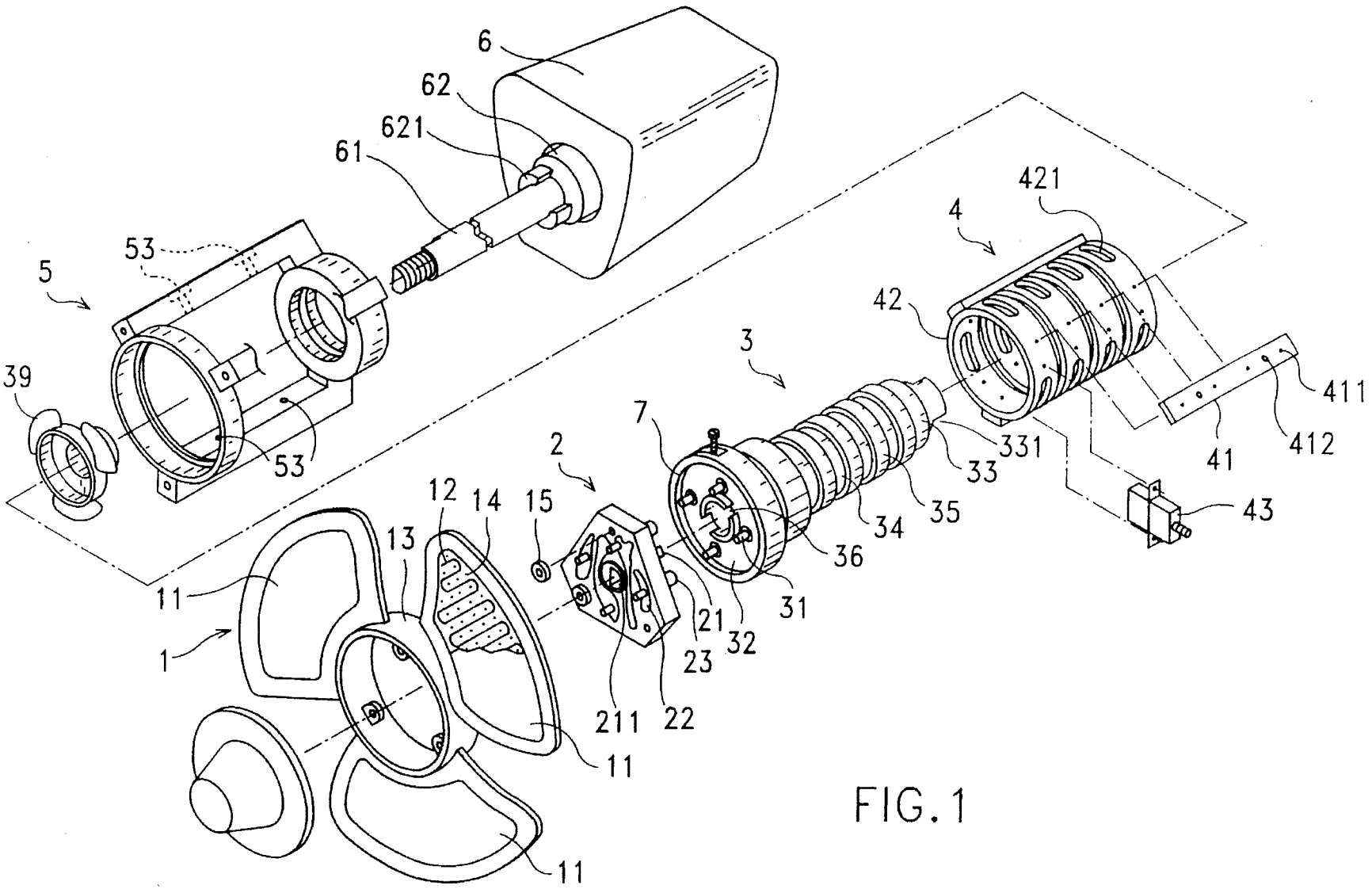
FIG. 1 is an exploded view of the preferred embodiment of the present invention.
Figure 2:
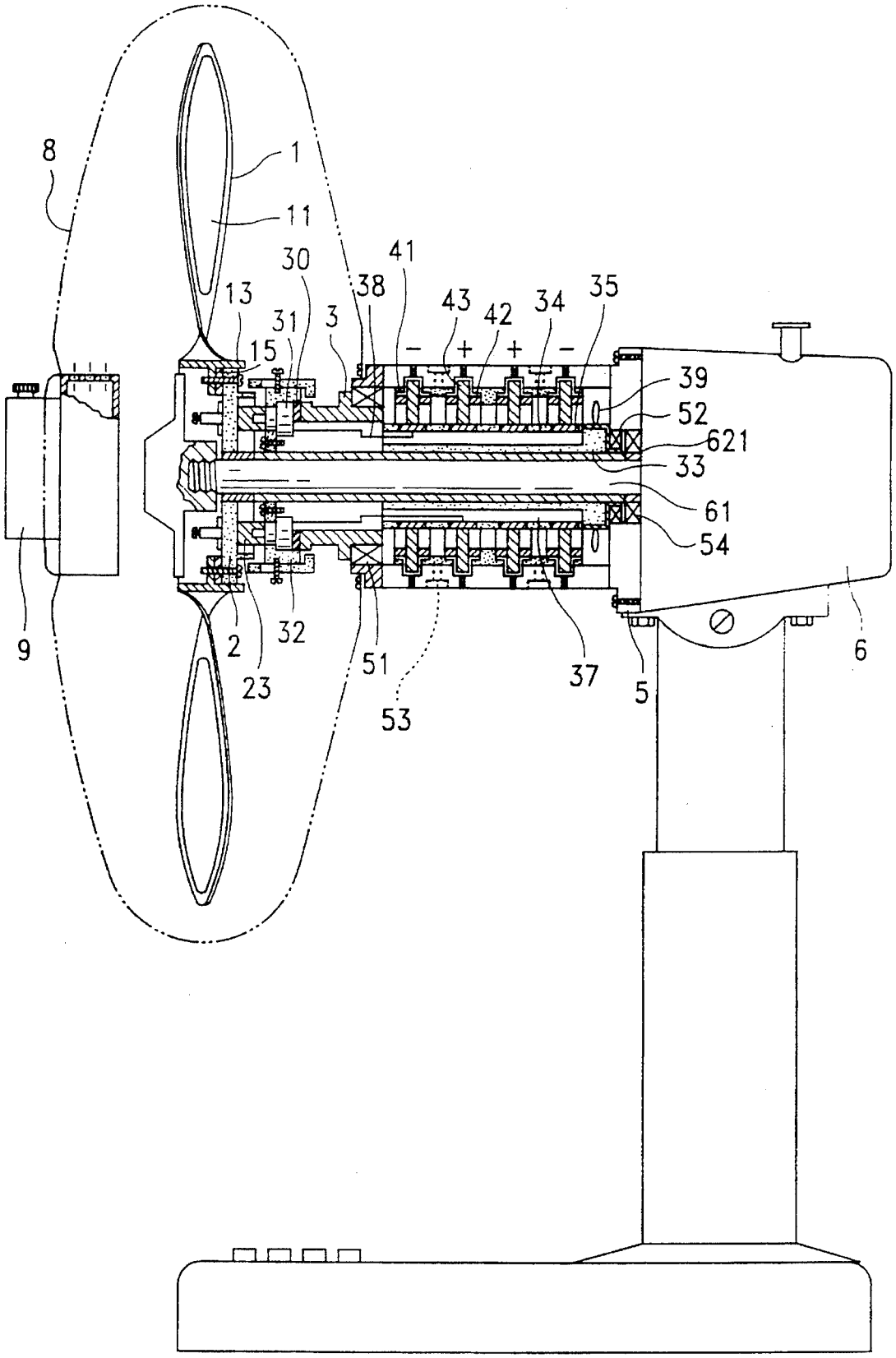
FIG. 2 is a sectional assembly view thereof.

Referring to FIGS. 1 and 2, an electric fan in accordance with the present invention is generally comprised of a series of vanes 1, a bakelite mount 2, a shaft 3, a barrel 4, and holder 5. The series of vanes 1 are radially fastened to a hub 13, each vane 1 comprising layers of mica sheets 11, at least one layer of heating coils 12 mounted in the layers of mica sheets 11, and a plurality of air vents holes 14 through the layers of mica sheets 11. The hub 13 is fastened to the bakelite mount 2 by screws (not shown) and insulative washers 15. The bakelite mount 2 comprises a coupling hole 211 at the center, a circuit board 22 at the front side, two juts 21 and four female contacts 23 at the back side and the female contacts 23 electrically connected to the circuit board 22. The shaft 3 comprises a bakelite plate 32 at the front end, a longitudinal coupling hole through the center of the bakelite plate 32 and coupled to the center coupling hole 211 of the bakelite mount 2, two first openings 36 around the coupling hole, four male contacts 31 raised from the bakelite plate 32 and insulated by a respective insulator 30 and respectively fastened to the female contacts 23, a jacket 7 mounted around the bakelite plate 32 and closely attached to the back side of the bakelite mount 2, a bakelite sleeve 33 covered around the periphery, two second openings 331 at one end of the shaft 3, four copper rings 35 mounted around the bakelite sleeve 33 and separated from one another by bakelite rings 34. A small vane & hub assembly 39 is coupled to the rear end of the shaft 3. The barrel 4 is mounted around the shaft 3, comprised of four copper rings 42 connected in line by a plurality of bakelite connecting bars 41. The copper rings 42 of the barrel 4 are respectively spaced around the copper rings 35 on the shaft 3, each having a plurality of slots 421 around the periphery and a carbon brush 43 fastened to one slot 421. The slots 421 on each copper ring 42 which are not mounted with any carbon brush are provided for ventilation. The carbon brush 43 on each copper ring 42 is for transmission of power supply to the copper rings 35 on the shaft 3 respectively. The connecting bars 41 have a plurality of longitudinally spaced first screw holes 411 respectively fastened to the copper rings 42 of the barrel 4 by respective screws, and a plurality of longitudinal spaced second screw holes 412 respectively fastened to respective screw holes 53 on the holder 5. The holder 5 is fastened in front of a high-speed or low-speed motor box 6 to hold the barrel 4 on the inside, having three axle bearings 51, 52 and 54 at two opposite ends mounted around the shaft 3. The motor inner and outer shaft 61, 62 which stretches from the motor box 6 is inserted through the axle bearing 54 on the holder 5 and the longitudinal coupling hole on the shaft 3, and then coupled to the coupling hole 211 on the mount 2. The juts 21 of the bakelite mount match with the first openings 36 of the shaft 3. The protrusions 621 extended from the outer shaft 62 match with the second openings 331 of the shaft 3 in the axle bearing 54. Therefore, when the motor is started, the series of vanes 1 and the small vane & hub assembly 39 are rotated to cause currents of air.

Figure 3:
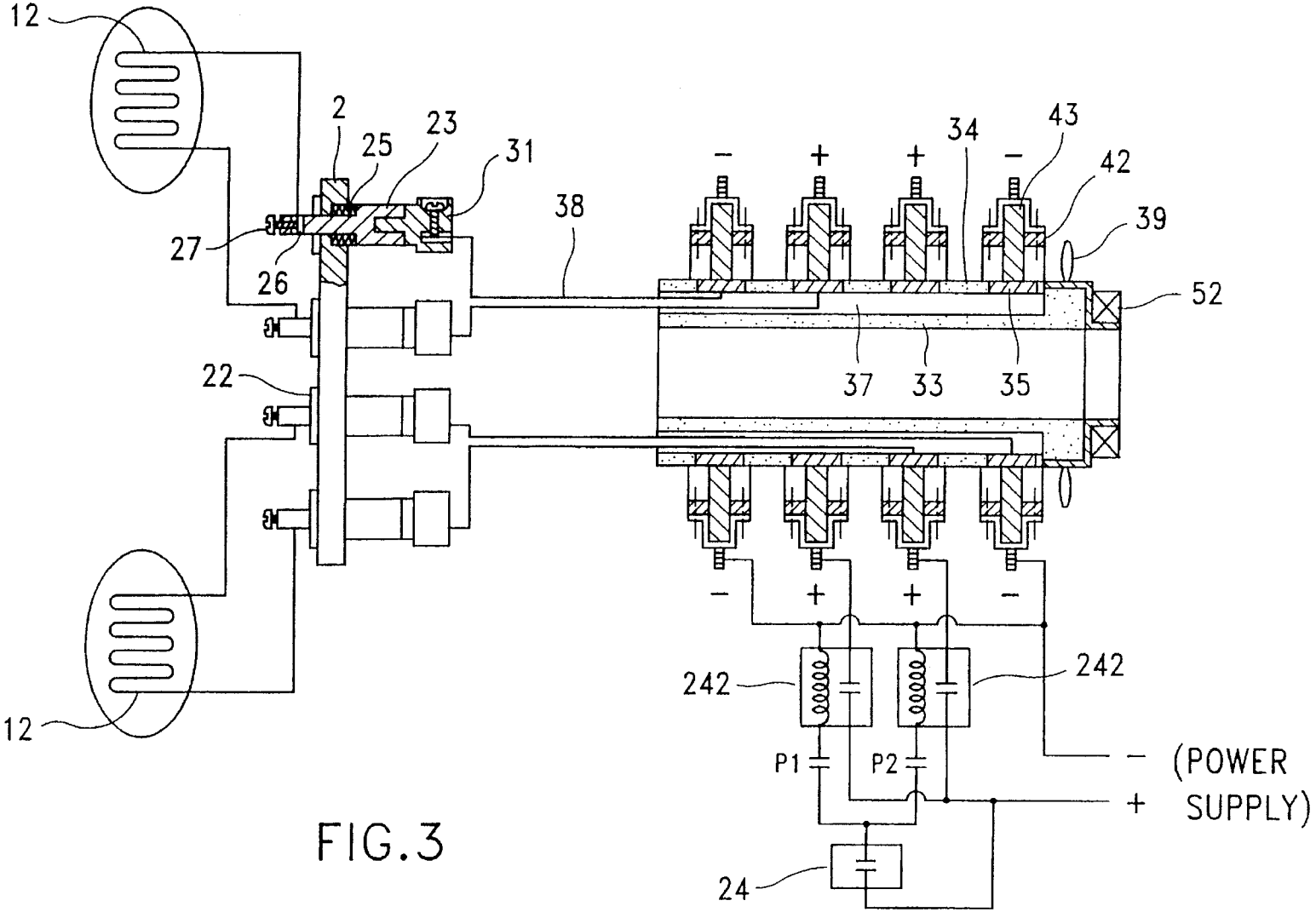
FIG. 3 is a circuit block diagram showing one arrangement of the control circuit according to the present invention.

Referring to FIG. 3 and FIG. 2 again, the sleeve 33 has four longitudinal grooves 37. Four conductors 38 are respectively mounted in the longitudinal grooves 37 and connected between the copper rings 35 and the male contacts 31. The male contacts 31 are connected to the female contacts 23 to transmit power supply to the heating coils 12 on the series of vanes 1 through the control of the circuit board 22. When power is on, electric power supply is transmitted from the carbon brushes 43 through the copper rings 35, the male contacts 31, the female contacts 23, and the circuit board 22, then to the heating coils 12, causing the heating coils 12 to produce heat, and at the same time the series of vanes 1 are rotated to cause currents of air, and therefore currents of hot air are produced (see FIG. 3).

Figure 3A:
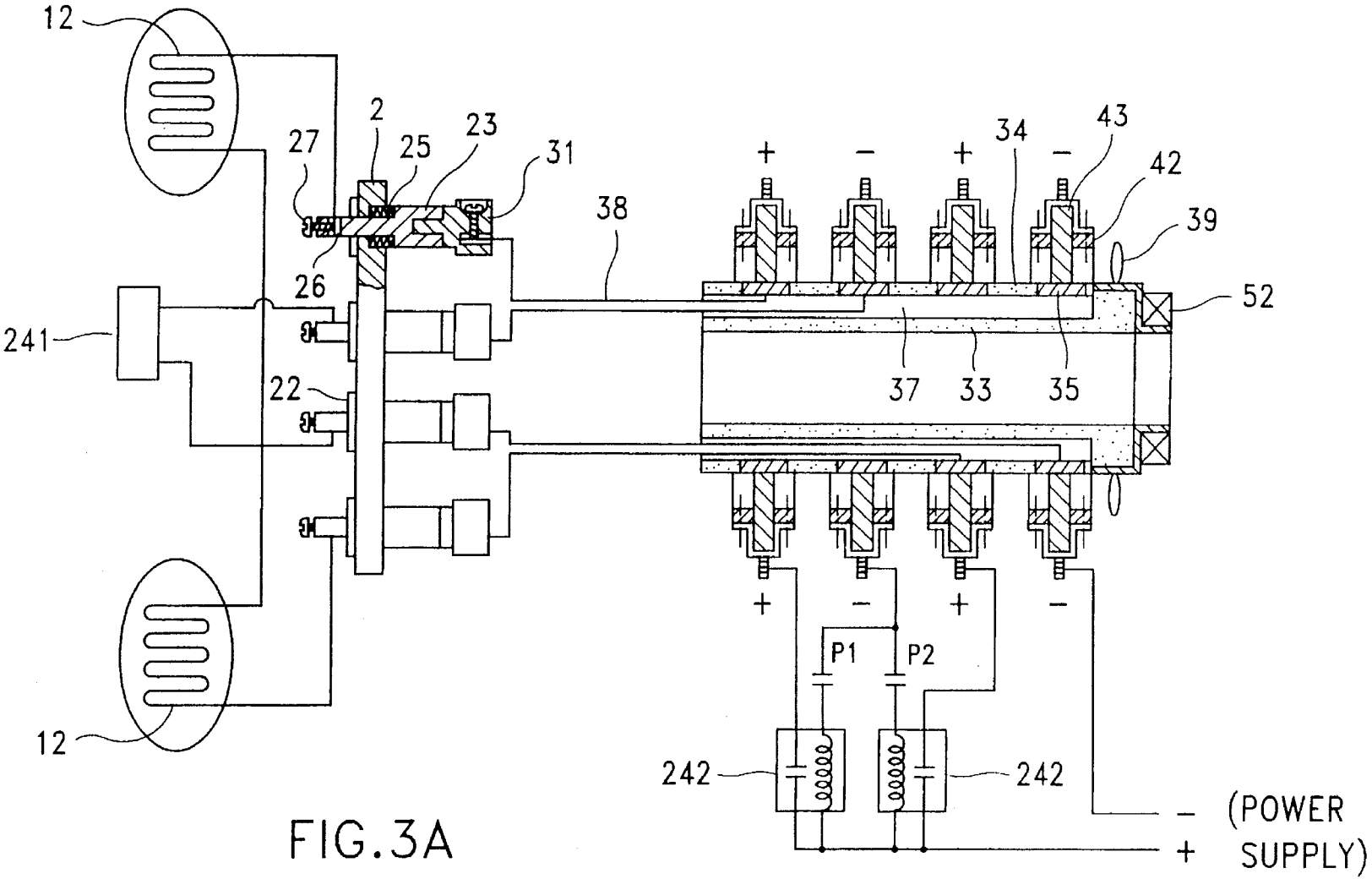
FIG. 3A is a circuit block diagram showing an alternate arrangement of the control circuit according to the present invention.

Referring to FIG. 3A, a control circuit is provided comprised of a temperature switch 241, a plurality of electromagnetic switches 242 and switches P1 and P2 for controlling the operation of the heating coils 12. When the motor is started after the heating coils 12 are turned off, the series of vanes 1 are rotated to produce currents of cold air.

Figure 3B:
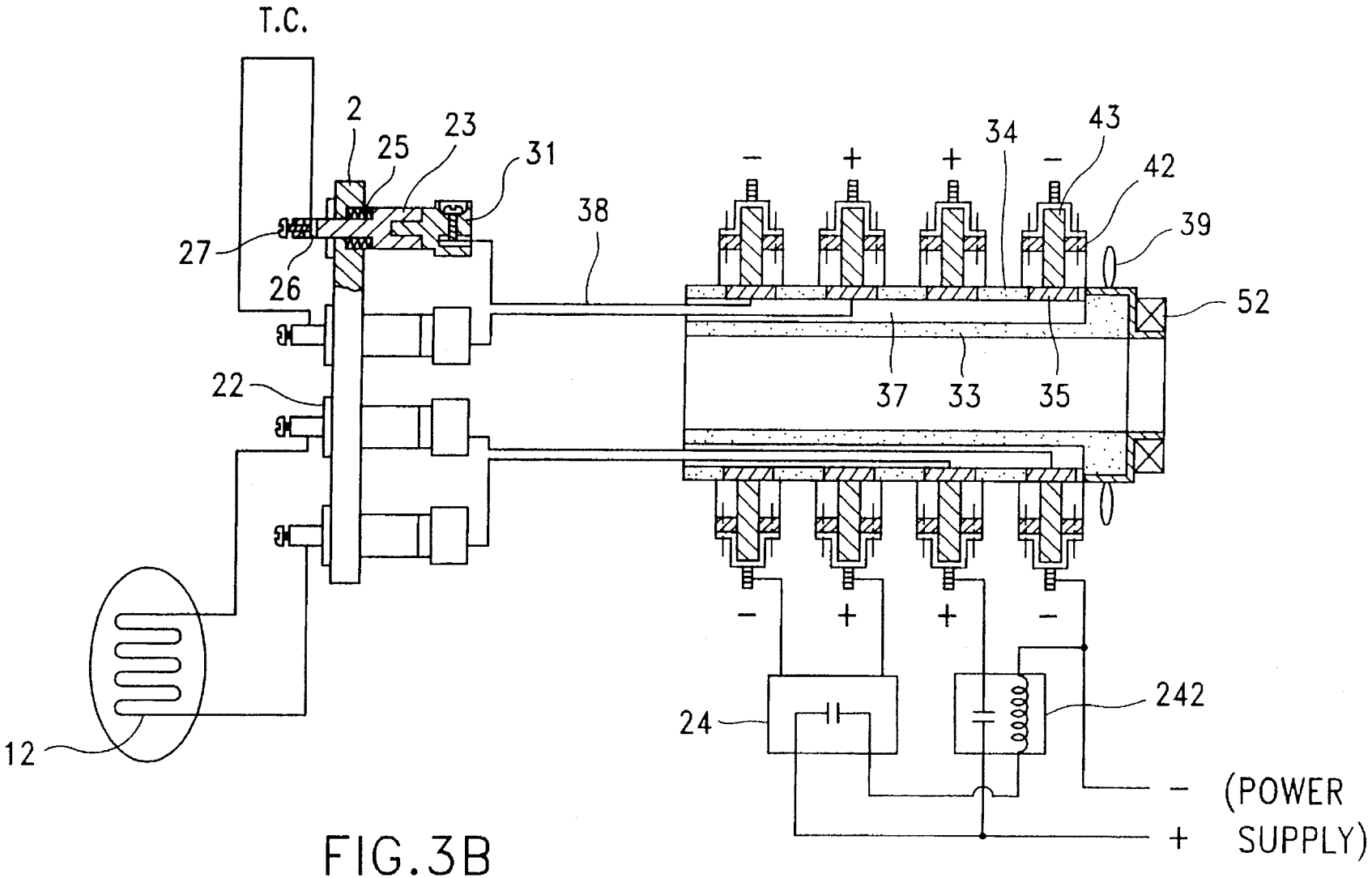
FIG. 3B is a circuit block diagram showing another alternate arrangement of the control circuit according to the present invention.

FIG. 3B shows another alternate form of the control circuit for controlling the operation of the heating coils 12 which is comprised of a single electromagnetic switch 242 which transmits power supply to the copper rings of the barrel at the same time and an adjustable thermostat 24.

Referring to FIG. 3B and FIG. 2 again, each female contact 23 is supported on the circuit board 22 by a respective compression spring 25, having a front wire hole 26 screwed up with a tie screw 27 to hold a respective conductor, which is connected to one heating coil 12. The series of vanes 1 is protected by a guard 8, which is mounted with an open container 9 for holding water for permitting water to be evaporated for regulating the indoor humidity.

It is to be understood that the drawings are designed for purposes of illustration only, and are not intended as a definition of the limits and scope of the invention disclosed.

I claim:

1. A hot air and cold air dual-mode electric fan comprising:

a vane assembly having a hub and a plurality of vanes mounted around said hub, each vane comprising layers of mica sheets, at least one electric heating coil mounted in said layers of mica sheets, and a plurality of vent holes through said mica sheets;

a bakelite mount fixedly secured to said vane assembly, said bakelite mount comprising a circuit board at one side adjacent to said vane assembly, and a plurality of female contacts longitudinally disposed at an opposite side and respectively connected to said electric heating coils on said vane assembly by said circuit board;

a shaft having a bakelite plate at one end adjacent to said bakelite mount, a plurality of male contacts raised from said bakelite plate and respectively connected to said female contacts, a bakelite sleeve mounted around a periphery of said bakelite plate, a plurality of copper rings mounted around said bakelite sleeve and separated from one another by bakelite rings and respectively connected to said female contacts by a respective conductor;

a barrel mounted around said shaft, said barrel comprising a plurality of longitudinally spaced copper rings joined by bakelite connecting bars, each copper ring of said barrel having a plurality of slots and a carbon brush mounted in one slot and disposed in contact with one respective copper ring on said shaft for transmitting electric power supply to said electric heating coils of said vane assembly;

a holder fixedly fastened in front of a motor and mounted around said barrel to hold said shaft inside said barrel for permitting said shaft and said bakelite mount and said vane assembly to be simultaneously turned by said motor; and a control circuit connected to said copper rings of said barrel for controlling power supply to said electric heating coils on said vane assembly so that said vane assembly produces currents of cold air when said motor is started and said control circuit is controlled to cut off power supply from the electric heating coils on said vane assembly, or currents of hot air when said motor is started and said control circuit is controlled to provide power supply to the electric heating coils on said vane assembly.

2. The hot air and cold air dual-mode electric fan of claim 1 wherein said motor is a low-speed motor.

3. The hot air and cold air dual-mode electric fan of claim 1 wherein said motor is a high-speed motor.

4. The hot air and cold air dual-mode electric fan of claim 1 wherein the male contacts of said shaft are respectively insulated by an insulator and then respectively connected to the female contacts on said bakelite mount.

5. The hot air and cold air dual-mode electric fan of claim 1 wherein said shaft comprises a front jacket mounted around said bakelite plate and closely attached to said bakelite mount to protect said male contacts and said female contacts against dust.

6. The hot air and cold air dual-mode electric fan of claim 1 wherein said vane assembly is protected by a guard, which has an open container for holding water for permitting water to be evaporated for regulating indoor humidity.

7. The hot air and cold air dual-mode electric fan of claim 1 wherein said control circuit comprises a plurality of electromagnetic switches controlled to transmit power supply to the copper rings of said barrel respectively, and a temperature switch for regulating the heating temperature of the electric heating coils on said vane assembly.

8. The hot air and cold air dual-mode electric fan of claim 1 wherein said control circuit comprises an electromagnetic switch controlled to transmit power supply to the copper rings of said barrel at the same time, and a thermostat for regulating the heating temperature of the electric heating coils on said vane assembly.

* * * * *